US009257083B2

(12) United States Patent
Dai

(10) Patent No.: US 9,257,083 B2
(45) Date of Patent: Feb. 9, 2016

(54) SELF-HEALING GATE DRIVING CIRCUIT HAVING TWO PULL-DOWN HOLDING CIRCUITS CONNECTED VIA A BRIDGE CIRCUIT

(71) Applicant: Shenzhen China Star Optoelectronics Technology Co., Ltd., Shenzhen, Guangdong (CN)

(72) Inventor: Chao Dai, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 53 days.

(21) Appl. No.: 14/348,680

(22) PCT Filed: Jan. 21, 2014

(86) PCT No.: PCT/CN2014/070950

§ 371 (c)(1),
(2) Date: Mar. 31, 2014

(87) PCT Pub. No.: WO2015/096245

PCT Pub. Date: Jul. 2, 2015

(65) Prior Publication Data

US 2015/0187302 A1 Jul. 2, 2015

(30) Foreign Application Priority Data

Dec. 27, 2013 (CN) ..... 2013 1 0739642

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01); *G09G 3/3677* (2013.01); *G09G 2330/08* (2013.01)

(58) Field of Classification Search
CPC .. G09G 2330/08; G09G 3/006; G09G 3/3648
USPC ..... 345/98–100
See application file for complete search history.

(56) References Cited

U.S. PATENT DOCUMENTS

| | | | | |
|---|---|---|---|---|
| 2010/0214279 | A1* | 8/2010 | Kim et al. | 345/213 |
| 2011/0234577 | A1* | 9/2011 | Yang et al. | 345/212 |
| 2012/0140871 | A1* | 6/2012 | Yang et al. | 377/79 |
| 2014/0103983 | A1* | 4/2014 | Chang et al. | 327/198 |

* cited by examiner

*Primary Examiner* — Long D Pham
(74) *Attorney, Agent, or Firm* — Andrew C. Cheng

(57) ABSTRACT

The claimed invention is related to a self-healing gate driving circuit. The self-healing gate driving circuit includes a plurality of GOA units connected in cascade. The N-th level GOA unit includes a pull-up control circuit 100, a pull-up circuit 200, a transfer-down circuit 300, a pull-down circuit 400, a boast capacitor 500, a first pull-down holding circuit 600, a second pull-down holding circuit 700 and a bridge circuit 500. The bridge circuit 800 includes the first TFT T55, and the gate of the TFT T55 connects to the gate signal point Q(N), and the drain and the source of the TFT T55 respectively connects to the first circuit point K(N) and the second circuit point P(N). During the operation, the first circuit point K(N) and the second circuit point P(N) are alternatively configured to be at a high potential. The self-healing gate driving circuit of the claimed invention can decrease the failure risk of the pull-down holding circuit due to the manufacture process or a long term operation of GOA circuit, and perform the function of the circuit self-healing.

15 Claims, 5 Drawing Sheets

SELF-HEALING GATE DRIVING CIRCUIT HAVING TWO PULL-DOWN HOLDING CIRCUITS CONNECTED VIA A BRIDGE CIRCUIT

BACKGROUND OF THE INVENTION

1. Field of the Invention

The present disclosure relates to liquid crystal technology, and more particularly to a self-healing gate driving circuit.

2. Discussion of the Related Art

The Gate Driver On Array (GOA) relates to integrating row-scanning driving signal circuit on array substrates through the conventional thin film transistor liquid crystal display (TFT-LCD) array manufacturing process perform so as to achieve row-by-row-scanning toward the gate.

The current GOA circuit usually includes the plural GOA units connected in cascade. Each of the GOA unit are configured to drive the corresponding horizontal scan line. The main construction of the GOA unit includes the pull-up circuit, the pull-up control circuit, the transfer-down circuit, the pull-down circuit, the pull-down holding circuit, and the boast capacitor for pulling up the potential.

The pull-up circuit is mainly responsible for outputting the clock signal as the gate signal. The pull-up control circuit is for controlling the turn-on time of the pull-up circuit, which is generally connected to the downward signal or the gate signal transferred from the previous level GOA unit. The pull-down circuit is for pulling down the gate to a low-potential, which means turning off the gate signal. The pull-down holding circuit is for holding the outputting signal of the gate and the gate signal of the pull-up circuit (usually named as the point Q) in the turn-off state (negative potential), and there are usually two pull-down holding circuits working alternatively. The boast capacitor is for the second pull-up of the point Q, which contributes to the G(N) output of the pull-up circuit.

1. According to the practical experiences, the pull-down holding circuit of the GOA circuits is most likely to be affected by the long stress, which will cause the break of some key TFTs, and thus increases the possibility of malfunctioned GOA circuits. Further, since the design of the current GOA circuits are not capable of self-healing, the possibility of such risk is highly raised.

2. During the GOA manufacturing process, due to the plenty of the circuit levels and the TFT numbers, the TFT may be short-connected or broken. Especially if such kind of situation happens in the pull-down holding circuit, the pull-down holding circuit remains in the turn-on or turn-off state, which will affect the outputted waveform from Gate. Further, as it is not easy to fix the GOA circuit, the yield rate of the liquid crystal display (LCD) will be highly affected.

3. In practices, since there is a huge resistor-capacitor (RC) loading in the GOA circuit, resulting in great delay of the gate waveform, how to decrease the gate delay is deeply concerned. The turn-off state of the pull-down holding circuit during the period of outputting the gate waveform will directly affect the delay of the Gate waveform.

SUMMARY

The object of the claimed invention is to provide a self-healing gate driving circuit to reduce the failure risk of the pull-down holding circuit, which results from manufacture process or a long term operation of GOA circuit. As such, the circuit self-healing function is achieved.

In one aspect, a self-healing gate driving circuit comprises: a plurality of GOA units connected in cascade, and a N-th level horizontal scanning line in a display area is charged according to a control of a N-th level GOA unit; the N-th level GOA unit comprises a pull-up control circuit, a pull-up circuit, a transfer-down circuit, a pull-down circuit, a boast capacitor, a first pull-down holding circuit, a second pull-down holding circuit and a bridge circuit, wherein the pull-up circuit, the pull-down circuit, the first pull-down holding circuit, the second pull-down holding circuit and the boast capacitor respectively connect to a gate signal point and the N-th level horizontal scanning line, the pull-up control circuit and the transfer-down circuit respectively connect to the gate signal point, and the bridge circuit connects between the first pull-down holding circuit and the second pull-down holding circuit and connects to the gate signal point.

The bridge circuit comprises a first TFT, wherein a gate of the first TFT connects to the gate signal point, and a drain and a source of the first TFT respectively connect to a first circuit point and a second circuit point.

The first pull-down holding circuit comprises:

a second TFT, wherein a gate of the second TFT is inputted with a second clock signal, and a drain and a source of the second TFT are respectively inputted with a first clock signal and connect to the second circuit point;

a third TFT, wherein a gate of the third TFT connects to the third circuit point, and a drain and a source of the third TFT are respectively inputted with the first clock signal and connect to the second circuit point;

a fourth TFT, wherein a gate of the fourth TFT is inputted with the first clock signal, and a drain and a source of the fourth TFT are respectively inputted with the first clock signal and connect to a third circuit point;

a fifth TFT, wherein a gate of the fifth TFT connects to the second circuit point, and a drain and a source of the fifth TFT are respectively connects to the second circuit point and the third circuit point;

a sixth TFT, wherein a gate of the sixth TFT connects to the gate signal point, and a drain and a source of the sixth TFT are respectively connects to the second circuit point and inputted with a direct-current (DC) low voltage;

a seventh TFT, wherein a gate of the seventh TFT connects to the second circuit point, and a drain and a source of the seventh TFT are respectively inputted with the DC low voltage and connects to the N-th level horizontal scanning line; and an eighth TFT, wherein a gate of the eighth TFT connects to the second circuit point, and a drain and a source of the eighth TFT are respectively inputted with the DC low voltage and connects to the gate signal point.

The second pull-down holding circuit comprises:

a ninth TFT, wherein a gate of the ninth TFT is inputted with the first clock signal, and a drain and a source of the ninth TFT are respectively inputted with the second clock signal and connects to the first circuit point;

a tenth TFT, wherein a gate of the tenth TFT connects to a fourth circuit point, and a drain and a source of the tenth TFT are respectively inputted with the second clock signal and connect to the first circuit point;

an eleventh TFT, wherein a gate of the eleventh TFT is inputted with the second clock signal, and a drain and a source of the eleventh TFT are respectively inputted with the second clock signal and connect to the fourth circuit point;

a twelfth TFT, wherein a gate of the twelfth TFT connects to the first circuit point, and a drain and a source of the twelfth TFT are respectively connect to the first circuit point and the fourth circuit point;

a thirteenth TFT, wherein a gate of the thirteenth TFT connects to the gate signal point, and a drain and a source of the thirteenth TFT are respectively connect to the fourth circuit point and inputted with the DC low voltage;

a fourteenth TFT, wherein a gate of the fourteenth TFT connects to the first circuit point, and a drain and a source of the fourteenth TFT are respectively inputted with the DC low voltage and connect to the N-th level horizontal scanning line; and a fifteenth TFT, wherein a gate of the fifteenth TFT connects to the first circuit point, and a drain and a source t of the fifteenth TFT are respectively inputted with the DC low voltage and connect to the gate signal point.

The low potential of the first clock signal and the second clock signal is smaller than the DC low voltage during their operations and frequencies thereof is smaller than the clock signal inputted to the pull-up circuit, and the first circuit point and the second circuit point are alternatively configured to be at a high potential.

Wherein the pull-up control circuit comprises a sixteenth TFT, and a gate of the sixteenth TFT is inputted with a transfer-down signal from the (N−1)-th level GOA unit, and a drain and a source are respectively connect to the (N−1)-th level horizontal scanning line and the gate signal point.

Wherein the pull-up circuit comprises a seventeenth TFT, the gate of the seventeenth TFT connects to the gate signal point, and a drain and a source of the seventeenth are respectively inputted with the clock signal and connect to the N-th level horizontal scanning line.

Wherein the transfer-down circuit comprises an eighteenth TFT, and a gate of the eighteenth TFT connects to the gate signal point, and a drain and a source of the eighteenth TFT are respectively inputted with the clock signal and output a downward signal.

Wherein the pull-down circuit comprises a nineteenth TFT, and a gate of the nineteenth TFT connects to a (N+1)-th level horizontal scanning line, and a drain and a source of the nineteenth TFT are respectively connect to the N-th level horizontal scanning line and inputted with the DC low voltage; a twentieth TFT, and a gate of the twentieth TFT connects to the (N+1)-th level horizontal scanning line, and a drain and a source of the twentieth TFT are respectively connect to the gate signal point and inputted with the DC low voltage.

Wherein the duty-cycle ratio of the clock signal is 50%.

Wherein the first clock signal is inputted to the cascaded GOA units via a common metal line.

Wherein the second clock signal is inputted to the cascaded GOA units via a common metal line.

Wherein the DC low voltage is inputted to the cascaded GOA units via a common metal line.

Wherein the initiating signal is inputted to a pull-up control circuit of the first level GOA unit and to a pull-down circuit of a last level GOA unit.

In another aspect, a self-healing gate driving circuit is further provided according to the claimed invention. The self-healing gate driving circuit comprises: a plurality of gate driver on array (GOA) units connected in cascade, and a N-th level horizontal scanning line in a display area is charged according to a control of a N-th level GOA unit; the N-th level GOA unit comprises a pull-up control circuit, a pull-up circuit, a transfer-down circuit, a pull-down circuit, a boast capacitor, a first pull-down holding circuit, a second pull-down holding circuit and a bridge circuit, wherein the pull-up circuit, the pull-down circuit, the first pull-down holding circuit, the second pull-down holding circuit and the boast capacitor respectively connect to a gate signal point and the N-th level horizontal scanning line, the pull-up control circuit and the transfer-down circuit respectively connect to the gate signal point, and the bridge circuit connects between the first pull-down holding circuit and the second pull-down holding circuit and connects to the gate signal point.

The bridge circuit comprises a first TFT, wherein a gate of the first TFT connects to the gate signal point, and a drain and a source of the first TFT respectively connect to a first circuit point and a second circuit point.

The first pull-down holding circuit comprises:

a second TFT, wherein a gate of the second TFT is inputted with a second clock signal, and a drain and a source of the second TFT are respectively inputted with a first clock signal and connect to the second circuit point;

a third TFT, wherein a gate of the third TFT connects to the third circuit point, and a drain and a source of the third TFT are respectively inputted with the first clock signal and connect to the second circuit point;

a fourth TFT, wherein a gate of the fourth TFT is inputted with the first clock signal, and a drain and a source of the fourth TFT are respectively inputted with the first clock signal and connect to a third circuit point;

a fifth TFT, wherein a gate of the fifth TFT connects to the second circuit point, and a drain and a source of the fifth TFT are respectively connects to the second circuit point and the third circuit point;

a sixth TFT, wherein a gate of the sixth TFT connects to the gate signal point, and a drain and a source of the sixth TFT are respectively connects to the second circuit point and inputted with a direct-current (DC) low voltage;

a seventh TFT, wherein a gate of the seventh TFT connects to the second circuit point, and a drain and a source of the seventh TFT are respectively inputted with the DC low voltage and connects to the N-th level horizontal scanning line; and an eighth TFT, wherein a gate of the eighth TFT connects to the second circuit point, and a drain and a source of the eighth TFT are respectively inputted with the DC low voltage and connects to the gate signal point.

The second pull-down holding circuit comprises:

a ninth TFT, wherein a gate of the ninth TFT is inputted with the first clock signal, and a drain and a source of the ninth TFT are respectively inputted with the second clock signal and connects to the first circuit point;

a tenth TFT, wherein a gate of the tenth TFT connects to a fourth circuit point, and a drain and a source of the tenth TFT are respectively inputted with the second clock signal and connect to the first circuit point;

a eleventh TFT, wherein a gate of the eleventh TFT is inputted with the second clock signal, and a drain and a source of the eleventh TFT are respectively inputted with the second clock signal and connect to the fourth circuit point;

a twelfth TFT, wherein a gate of the twelfth TFT connects to the first circuit point, and a drain and a source of the twelfth TFT are respectively connect to the first circuit point and the fourth circuit point;

a thirteenth TFT, wherein a gate of the thirteenth TFT connects to the gate signal point, and a drain and a source of the thirteenth TFT are respectively connect to the fourth circuit point and inputted with the DC low voltage;

a fourteenth TFT, wherein a gate of the fourteenth TFT connects to the first circuit point, and a drain and a source of the fourteenth TFT are respectively inputted with the DC low voltage and connect to the N-th level horizontal scanning line; and a fifteenth TFT, wherein a gate of the fifteenth TFT connects to the first circuit point, and a drain and a source t of the fifteenth TFT are respectively inputted with the DC low voltage and connect to the gate signal point.

The low potential of the first clock signal and the second clock signal is smaller than the DC low voltage during their operations, and frequencies thereof is smaller than the clock signal inputted to the pull-up circuit, and the first circuit point and the second circuit point are alternatively configured to be at a high potential.

Wherein the pull-up control circuit comprises a sixteenth TFT, and a gate of the sixteenth TFT is inputted with a transfer-down signal from the (N−1)-th level GOA unit, and a drain and a source are respectively connect to the (N−1)-th level horizontal scanning line and the gate signal point.

Wherein the pull-up circuit comprises a seventeenth TFT, the gate of the seventeenth TFT connects to the gate signal point, and a drain and a source of the seventeenth are respectively inputted with the clock signal and connect to the N-th level horizontal scanning line.

Wherein the transfer-down circuit comprises an eighteenth TFT, and a gate of the eighteenth TFT connects to the gate signal point, and a drain and a source of the eighteenth TFT are respectively inputted with the clock signal and output a downward signal.

Wherein the pull-down circuit comprises a nineteenth TFT, and a gate of the nineteenth TFT connects to a (N+1)-th level horizontal scanning line, and a drain and a source of the nineteenth TFT are respectively connect to the N-th level horizontal scanning line and inputted with the DC low voltage; a twentieth TFT, and a gate of the twentieth TFT connects to the (N+1)-th level horizontal scanning line, and a drain and a source of the twentieth TFT are respectively connect to the gate signal point and inputted with the DC low voltage.

Wherein the duty-ratio of the clock signal is 50%.

Wherein the first clock signal is inputted to the cascaded GOA units via a common metal line.

Wherein the second clock signal is inputted to the cascaded GOA units via a common metal line.

Wherein the DC low voltage is inputted to the cascaded GOA units via a common metal line.

Wherein the initiating signal is inputted to a pull-up control circuit of the first level GOA unit and to a pull-down circuit of a last level GOA unit.

In view of the above, the self-healing gate driving circuit is capable of reducing the failure risk of the pull-down holding circuit, which results from manufacture process or a long term operation of GOA circuit. As such, the circuit self-healing function is achieved. In addition, the impact of the pull-down holding circuit toward the delay of gate waveform output is reduced so as to guarantee the gate waveform output. Furthermore, the yield rate of the GOA panel and the reliability of the GOA circuit are enhanced.

In order to further understand the characteristics of the invention as well as technical content, see the following detailed description of the present invention and the accompanying drawings, drawings, however, for reference purposes only and description of use is not intended to limit the present invention.

BRIEF DESCRIPTION OF THE DRAWINGS

Below in conjunction with the accompanying drawings, through a specific embodiment of the present invention is described in detail, and will make apparent the technical solution of the present invention, and other beneficial effects.

DETAILED DESCRIPTION OF THE EMBODIMENTS

Embodiments of the invention will now be described more fully hereinafter with reference to the accompanying drawings, in which embodiments of the invention are shown.

Figure 1:
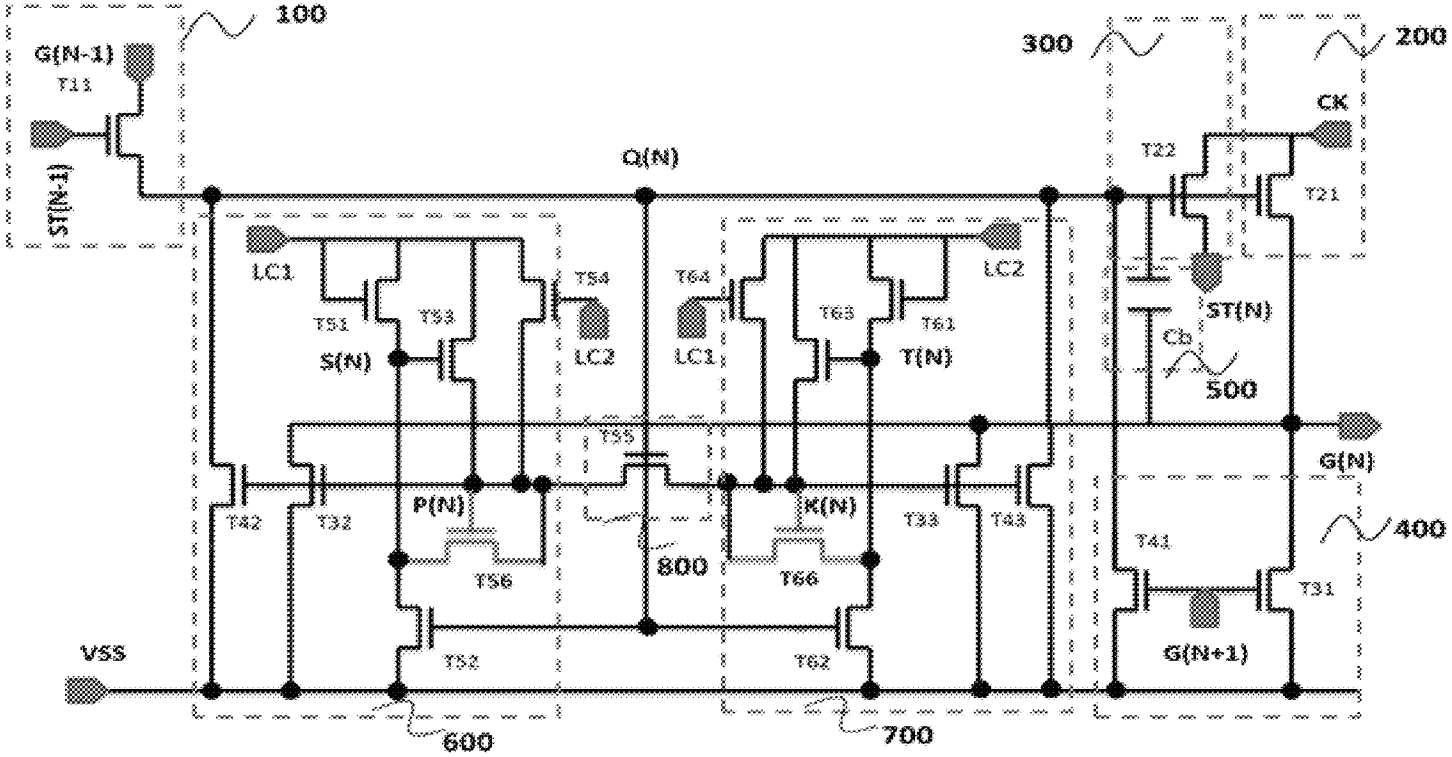
FIG. 1 is a circuit diagram showing the self-healing gate driving circuit in accordance with one embodiment.

Please refer to FIG. 1, which is a circuit diagram showing the self-healing gate driving circuit according to an embodiment. The self-healing gate driving circuit includes a plurality of GOA units connected in cascade, and the N-th level horizontal scanning line G(N) in the display area is charged according to a control of a N-th level GOA unit. The Nth level GOA unit includes a pull-up control circuit 100, a pull-up circuit 200, a transfer-down circuit 300, a pull-down circuit 400, a boast capacitor 500, a first pull-down holding circuit 600, a second pull-down holding circuit 700 and a bridge circuit 500. The pull-up circuit 200, the pull-down circuit 400, the first pull-down holding circuit 600, the second pull-down holding circuit 700 and the boast capacitor 500, respectively connects to the gate signal point Q(N) and the N-th level horizontal scanning line G (N), the pull-up control circuit 100 and the transfer-down circuit 300 respectively connects to the gate signal point Q(N), and the bridge circuit 800 connects between the first pull-down holding circuit 600 and the second pull-down holding circuit 700 and connects to the gate signal point Q(N). The first pull-down holding circuit 600, the second pull-down holding circuit 700, and the bridge circuit 800 construct the design of the three-stage voltage division.

The pull-up control circuit includes the TFT T11, and the gate of T11 is inputted with a transfer-down signal ST (N−1) from the (N−1)-th level GOA unit, and the drain and the source of T11 respectively connects to the (N−1)-th level horizontal scanning line G (N−1) and the gate signal point Q(N). The pull-up circuit 200 includes the TFT T12, the gate of T12 connects to the gate signal point Q(N), and the drain and the source of T12 are respectively inputted with the clock signal CK and connect to the N-th level horizontal scanning line G(N). The transfer-down circuit 300 includes the TFT T22, and the gate of T22 connects to the gate signal point Q(N), and the drain of T22 is inputted with the clock signal CK and the source of T22 outputs a downward signal respectively. The pull-down circuit 400 includes a TFT T31, and the gate of T31 connects to a (N+1)-th level horizontal scanning line G(N+1). The drain and the source of T31 respectively connects to the Nth level horizontal scanning line G(N) and is inputted with the direct-current (DC) low voltage Vss. The pull-down circuit 400 further includes the TFT T41, and the gate of T41 connects to the (N+1)-th level horizontal scanning line G(N+1), and the drain of T41 connects to the gate signal point Q(N) and the source of T41 is inputted with the DC low voltage VSS respectively.

The bridge circuit 800 includes the TFT T55, and the gate of the TFT T55 connects to the gate signal point Q(N), and the drain and the source of the TFT T55 respectively connects to the first circuit point K(N) and the second circuit point P(N).

The first pull-down holding circuit 600 includes the TFT T54, and the gate of the TFT T54 is inputted with the second clock signal LC2, and the drain and the source of the TFT T54 are respectively inputted with the first clock signal LC1 and connects to the second circuit point P(N). The first pull-down holding circuit 600 also includes the TFT T53, the gate of the TFT T53 connects to the third circuit point S(N), and the drain and the source of the TFT T53 are respectively inputted with the first clock signal LC1 and connect to the second circuit point P(N). The first pull-down holding circuit 600 also includes the TFT T51, the gate of TFT T51 is inputted with the first clock signal LC1, and the drain and the source of TFT T51 are respectively inputted with the first clock signal LC1 and connect to the third circuit point S(N). The first pull-down holding circuit 600 also includes the TFT T56, the gate of the TFT T56 connects to the second circuit point P(N), and a drain and a source thereof are respectively coupled to the second circuit point P(N) and the third circuit point S(N). The first pull-down holding circuit 600 also includes the TFT T52, and the gate of the TFT T52 connects to the gate signal point Q(N), and the drain and the source of the TFT T52 connects to the second circuit point P(N) and is inputted with a direct-current (DC) low voltage VSS respectively. The first pull-down holding circuit 600 also includes the TFT T32, the gate of the TFT T32 connects to the second circuit point P(N), and the drain and the source of the TFT T32 is inputted with the DC low voltage VSS and connects to the N-th level horizontal scanning line G(N) respectively. The first pull-down holding circuit 600 also includes the TFT T42, and the gate of the TFT T42 connects to the second circuit point P(N), and the drain and the source of the TFT T42 are respectively inputted with the DC low voltage Vcc and connects to the gate signal point Q(N).

The second pull-down holding circuit 700 includes the TFT T64, and the gate of the TFT T64 is inputted with the first clock signal LC1. The drain and the source of the TFT T64 are respectively inputted with the second clock signal LC2 and connect to the first circuit point K (N). The second pull-down holding circuit 700 includes the TFT T63, and the gate of the TFT T63 connects to the fourth circuit point T(N). The drain and the source of the TFT T63 are inputted with the second clock signal LC2 and connect to the first circuit point K(N) respectively. The second pull-down holding circuit 700 includes the TFT T61, and the gate of the TFT T61 is inputted with the second clock signal LC2. The drain and the source of the TFT T61 are inputted with the second clock signal LC2 and connect to the fourth circuit point T(N) respectively. The second pull-down holding circuit 700 includes the TFT T66, and the gate of the TFT T66 connects to the first circuit point K(N), and the drain and the source of the TFT T66 connects to the first circuit point K(N) and the fourth circuit point T(N) respectively. The second pull-down holding circuit 700 includes the TFT T62, and the gate of T62 connects to the gate signal point Q(N), and the drain and the source of T62 respectively connect to the fourth circuit point T(N) and are inputted with the DC low voltage VSS. The second pull-down holding circuit 700 includes the TFT T33, and the gate of T33 connects to the first circuit point K(N), and the drain and the source of T33 are respectively inputted with the DC low voltage VSS and connects to the N-th level horizontal scanning line G(N). The second pull-down holding circuit 700 includes the TFT T34, and the gate of T34 connects to the first circuit point K(N), and the drain and the source of T34 are respectively inputted with the DC low voltage VSS and connects to the gate signal point Q(N).

During the operations, the low potential of the first clock signal LC1 and the second clock signal LC2 is smaller than the DC low voltage VSS, and the frequencies is smaller than the clock signal CK inputted to the pull-up circuit 200, and the first circuit point K(N) and the second circuit point P(N) are alternatively configured to be at a high potential.

The bridge circuit 800 mainly modulates the potential of the two terminals P(N) and K(N) through the bridge TFT T55. The gate of the TFT T55 connects to the Q (N), and the drain and the source of the TFT T55 connects to the P(N) and K(N) respectively. During the operations, the gate of the TFT T55 turns on such that the potential of the P(N) and the K(N) are close to the potential of the turn-off state. Furthermore, since the low potential of the low-frequency signal LC1 and LC2 is smaller than the VSS, the potential of the P(N) and the K(N) can be modulated smaller than the VSS during the operation, which ensures pulling down the Vgs of T32 and T33 of the point G(N) as well as the Vgs of T42 and T43 of the point Q to be smaller than zero, and can preferably prevent the leakage of electricity from the point G(N) and the point Q during the operation.

The first pull-down holding circuit 600 and the second pull-down holding circuit 700 are designed symmetrically, which perform the following purposes. Firstly, while the first pull-down holding circuit 600 (the second pull-down holding circuit 700) is in the turn-off state of high resistance, the second pull-down holding circuit 700 (the first pull-down holding circuit 600) is in the turn-on state of low resistance. The turn-on state of low resistance of the bridge circuit 800 will lead the P(N) and the K(N) to be in the low-potential state so as to ensure the point Q(N) is raised and the output of the gate. Secondly, both the first pull-down holding circuit 600 and the second pull-down holding circuit 700 are in the turn-on state of low resistance during the inactive period, and the bridge circuit 800 is in the turn-off state of high resistance so as to achieve the high/low potential alternation of the P(N) and the K(N).

Moreover, the gate of T54 connects to LC2, the drain of T54 connects to LC1, and the source of T54 connects to P(N). The gate of T64 connects to LC1, the drain of T64 connects to LC2, and the source of T64 connects to L(N). The state of the two TFT can be described as Balance. The TFTs mainly contribute to the modulation of voltage division of resistors and the fast discharge while signal switching. The gate of T52 connects to Q(N), the drain of T52 connects to S(N), and the source of T52 connects to VSS. The gate of T62 connects to Q(N), the drain of T62 connects to T(N), and the source of T62 connects to VSS. The main purpose of the two TFTs is to ensure pulling down the S(N) and T(N) during the operation.

Figure 2:
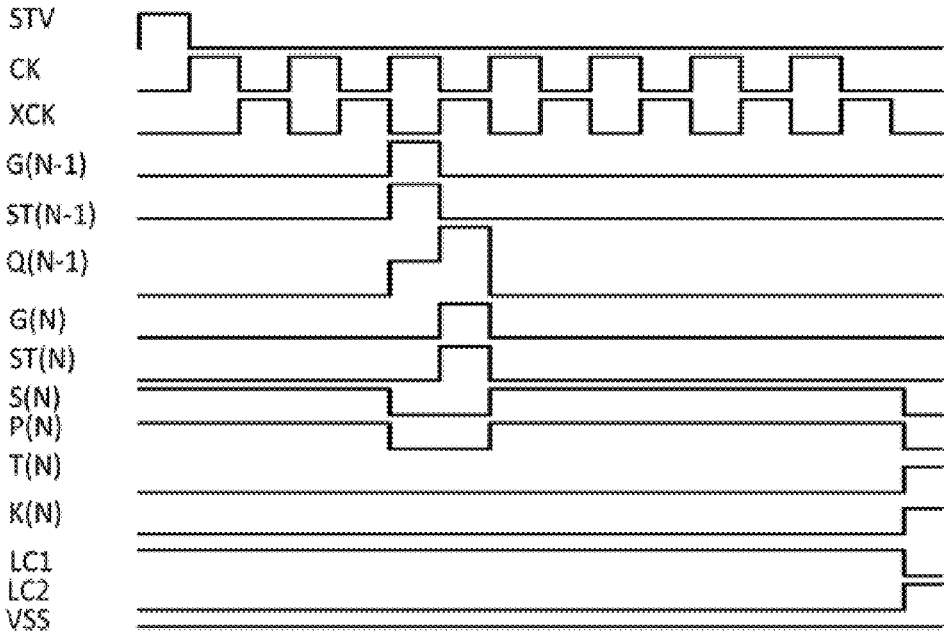
FIG. 2 is a waveform diagram showing a variety of outputting/inputting signals of the self-healing gate driving circuit of FIG. 1.

According to such circuit design, the two TFTs T56 and T66, which operate as diode with self-healing function, are adopted by the pull-down holding circuit. The gate and drain of T56 connects to P(N), and the source of T56 connects to S(N). The gate and drain of T66 connects to K(N), and the source of T66 connects to T(N). Such design can prevent the risk of circuit malfunction which induced by the broke of the bridge TFT T55. The two situations concerning the short circuit and the open circuit to the circuit of T55 will be analyzed substantially as follows. FIGS. 1 and 2 are mainly used to illustrate the normal situation of the circuit.

In one embodiment, a new pull-down holding circuit of the GOA, which applies the principle of the three-stage voltage division includes the first pull-down holding circuit 600, the second pull-down holding circuit 700, and the bridge circuit 800. It improves the stability in high temperature and the reliability of long-term operation. Also, by fully utilizing the function the low-frequency signal, it performs the switch of P(N) and K(N), and pull down the potential of P(N) and K(N) to a lower level, which ensures the decrease of the electric leakage from the point Q and the gate in the maximum. Meanwhile, one of P(N) and K(N) will be in a low potential which closes to the low potential of LC1 and LC2 during the inactive period. Because the low potential of LC1 and LC2 is smaller than VSS, T32/T42 or T33/T43 can have a period more than a half time in the restoration state of negative pressure stress, and the potential of the negative pressure stress can be controlled through modulating the low potential of low-frequency signal, which can decrease the risk of malfunction of the pull-down holding circuit efficiently.

The two TFTs T56 and T66, which are capable of self-healing and applied in the self-healing circuit, will not affect the function of the circuit during the normal operation. The normal conduction and the back leakage current of the diode-designed TFT will not affect the operation of the circuit. In contrast, the linkage between P(N)/K(N) and S(N)/T(N) can be performed accordingly, and it can be faster for P(N)/K(N) and S(N)/T(N) to be pulled down to the turn-off state of low-potential, which can benefits the outputs of Q(N) and G(N).

Please refer to FIG. 2, which is a waveform diagram showing the outputting/inputting signals of the self-healing gate driving circuit as illustrated in FIG. 1. As shown, the duty-cycle ratio of the high frequency signal adopted by a set of clock control signals of the GOA circuit is 50/50. In real scenarios, the duty-cycle ratio of the clock signals can be configured to be different so as to drive the GOA circuit. Also, a plurality of sets of the high-frequency clock signals can be designed according to the LCD panel loading.

The STV signal is the initiating signal of the GOA circuit, and hence the STV signal is responsible for initiating the first level GOA circuits. The ST(N−1) signal of the transfer-down circuit of the previous level circuit is provided as the initiating signal of the next level GOA circuit, by which the GOA driving circuit can be initiated from level to level and drives the row-scan.

The CK and XCK is a pair of high-frequency clock signals having the same high and low potential but phases are opposite to each other. The pulse width, the period, and the potential of the clock signal mainly depend on the design requirement according to the gate waveform of LCD panel. Therefore, the duty-cycle ratio in the practical application of the LCD is not necessarily to be 50/50 as illustrated as the figures. It can be understood that different clock signals may be adopted for enduring different loading according to the panel design.

The signal G(N−1), which is the outputting signal from the gate the of previous level, and the signal ST(N−1) from the previous level GOA circuit are both responsible for initiating the N-th level GOA circuit, which is showed as the transistor T11 in the pull-up control circuit 100 of FIG. 1.

The potential of the node Q(N) waveform is raised twice for easily initiating the pull-up circuit, which contributes to the output of the gate waveform. Further, the node Q(N) is also responsible for turning off the action from the pull-down holding circuit to Q(N) and G(N) during the operation of the gate outputting signal. As illustrated in FIG. 2, S(N) and P(N) are pulled down to a low potential, and the negative potential determine directly the waveform outputted from the gate.

G(N) is the gate waveform generated by the present level GOA circuit, which is identical to the pulse width of the time-space control signal. ST(N) is the signal generated by the T22 of the transfer-down circuit, and both ST(N) and G(N) are responsible for initiating the next level GOA circuit.

LC1 and LC2 are two alternate low-frequency clock signals for controlling the pull-down holding circuit, and for performing the alternation between P(N) and K(N) according to the division principle of the three-stage resistance divider. Based on such design, the function of the positive/negative signals of the set of the low-frequency clock signals can be fully developed. As illustrated in FIG. 2, the LC1 is in high potential and the LC2 is in low potential. The LC1 and the LC2 can be the signals which have the identical frequency but the opposite phases. If the LC1 is in low potential and the LC2 is in high potential, the situation will reverse, which means S(N) and P(N) will be in low potential and T(N) 和 K(N) will be in high potential.

VSS is the DC negative-voltage source for providing a stable turn-off state to the point Q and the gate during the period with no output.

Figure 3:
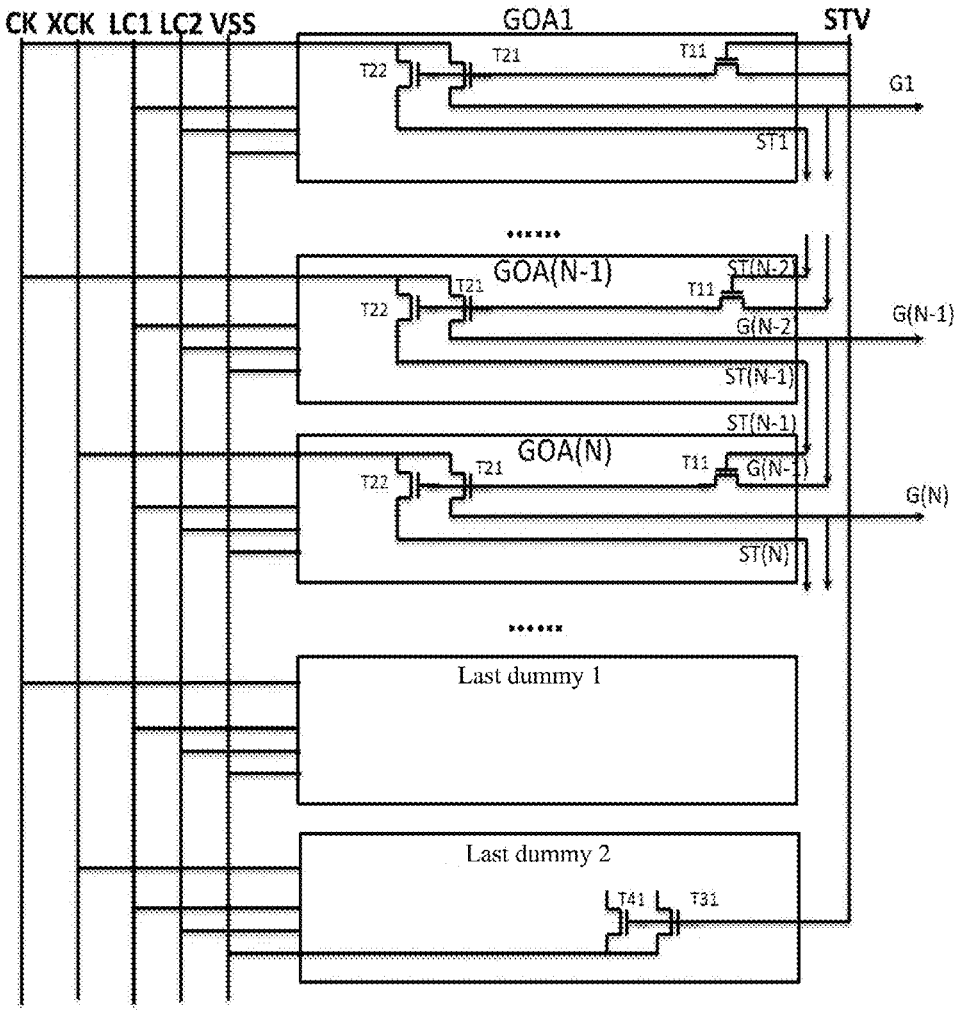
FIG. 3 is a schematic view showing the circuit structure and the cascade-connection of the self-healing gate driving circuit applying to liquid crystal panel in accordance with one embodiment.

Please refer to FIG. 3, which a schematic view showing the circuit structure and the cascade-connection of the self-healing gate driving circuit applying to liquid crystal panel in accordance with one embodiment. The signal STV connects not only to the T11 of the first level GOA unit in order to initiate the first level circuit, but also to the T31 and T41 of the last level (dummy level) GOA unit. In this way, the charges of the dummy level points Q and G are removed before a frame is initiated.

The GOA driving circuit can be divided into three parts, including an initiating part of the primary level, the normal transferring part of the middle level, and the last two dummy levels for pulling down the gates of the last two levels. The dummy level gate does not receive any loading from the display area.

The CK signal connects to T21 of the pull-up circuit and T22 of the transfer-down circuit of the odd-level GOA circuits. The XCK signal connects to T21 of the pull-up circuit and T22 of the transfer-down circuit of the even-level GOA circuits. Each level must connect to the signals generated by LC1, LC2, VSS, G(N), and ST(N) in order to initiate the next level GOA circuit, and operates successively in the same way to achieve the gate waveform output.

Figure 4:
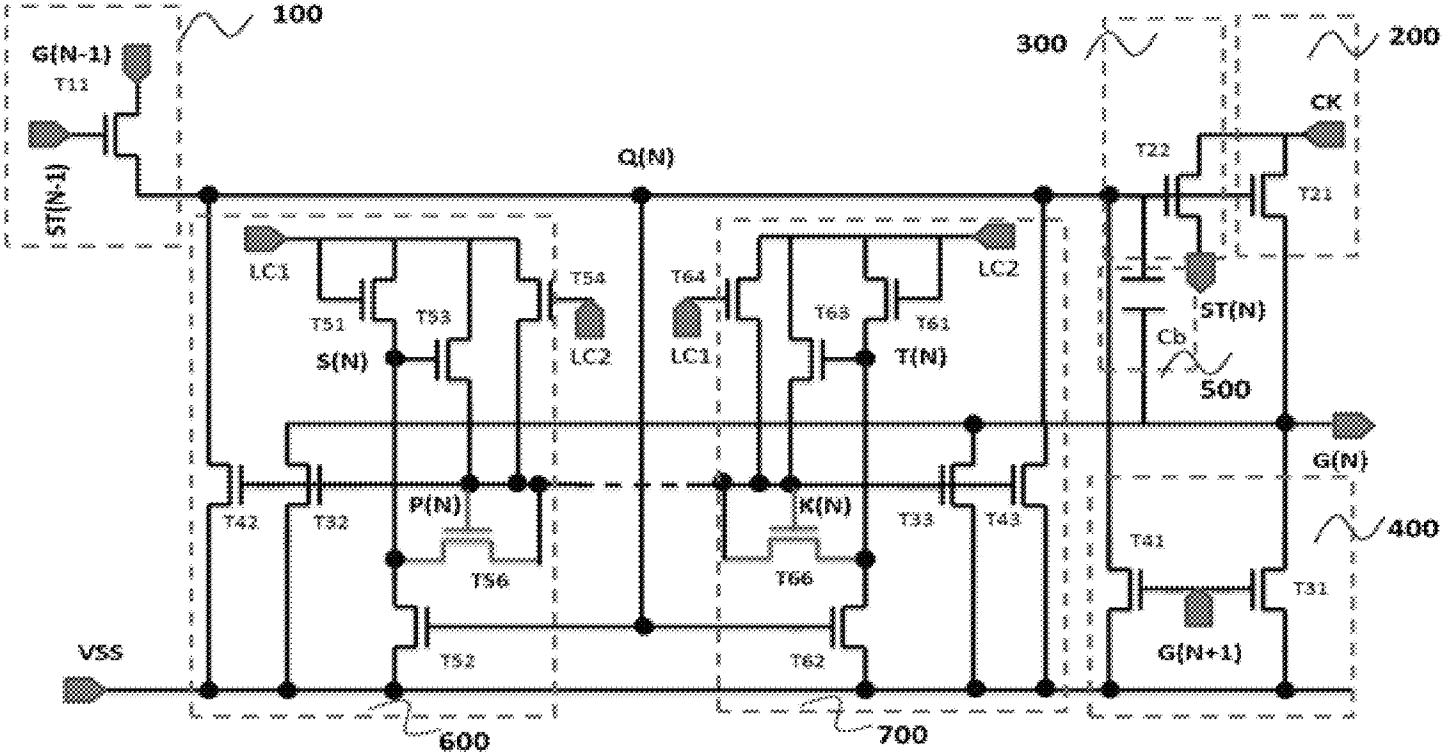
FIG. 4 is a schematic view showing the self-healing process of the self-healing gate driving circuit in a short-connected state in accordance with one embodiment.

Please refer to FIG. 4, which is a schematic view showing the self-healing process of the self-healing gate driving circuit. In FIG. 4, it is assumed that the bridge TFT T55 of FIG. 1 is shorted. After T55 is shorted, the pull-down holding circuit transits from three-stage resistance divider to two-stage resistance divider. The potential of P(N) and K(N) are the same at this stage and would not change due to the alternation of LC1 and LC2. The potential is at high level during the inactive period, and the high potential is determined according to the sizes of the TFTs adopted by P(N)/K(N) for voltage division.

When LC1 is in high potential during its operation, S(N) still may be pulled down to the low potential, which turns off the T53. This ensures that P(N)/K(N) can be pulled down to the low potential (closing to the low potential of LC2), and will not affect the normal outputs of the points Q(N) and G(N). Further, the TFTs T56 and T66 which includes the design of two diodes can ensure that P(N)/K(N) will not generate the over-high potential, and it is because that when the potential of P(N)/K(N) is over-high, T56 and T6 will be in the turn-on stage automatically, which pulls the potential of P(N) and K(N) to the similar potential level of S(N)/T(N).

Through such self-healing design, the risk brought by the short circuit of T55 can be decreased efficiently, which ensure that even if the TFT which plays the key role in the pull-down holding circuit fails, the GOA circuit can still function normally.

Figure 5:
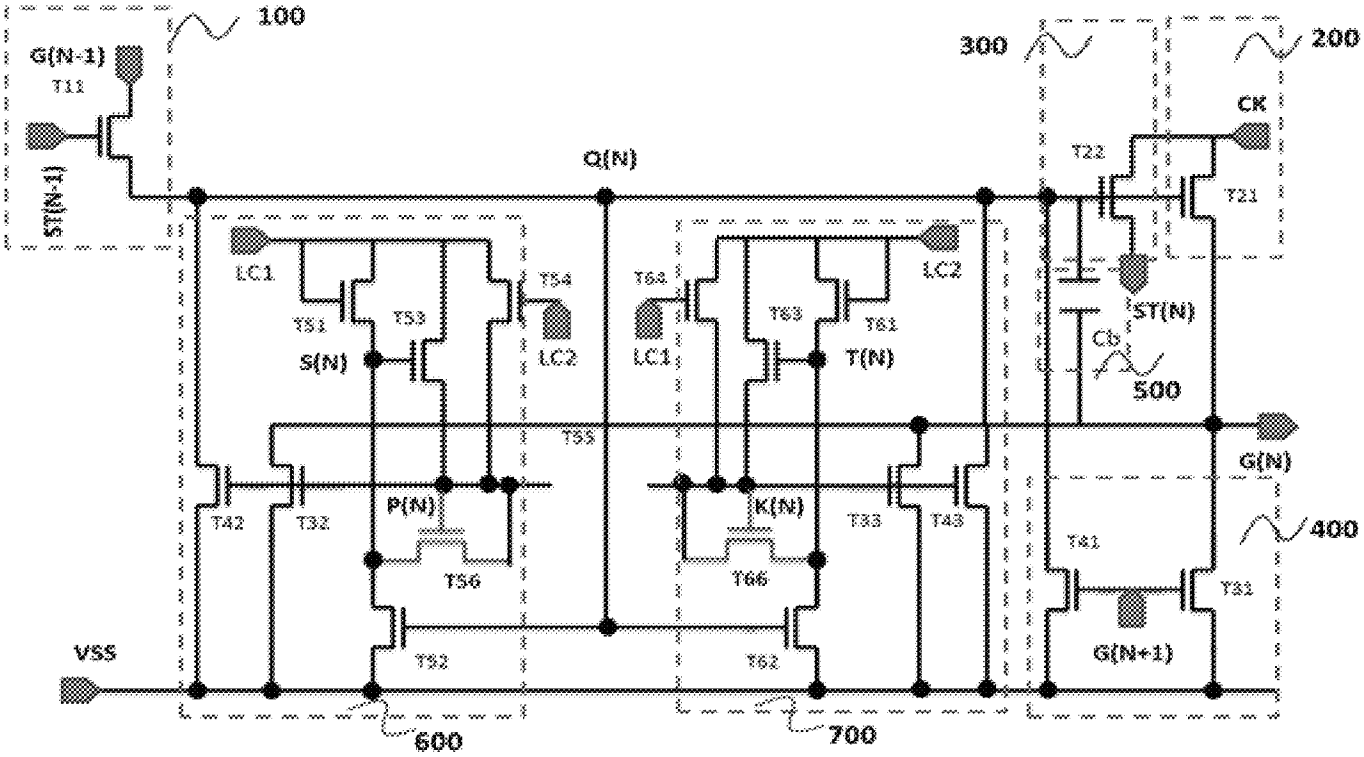
FIG. 5 is a schematic view showing the self-healing process of the self-healing gate driving circuit in an open state in accordance with one embodiment.

Please refer to FIG. 5, which is a schematic view showing the self-healing process of the self-healing gate driving circuit in the open state. In FIG. 5, it is assumed that the bridge TFT T55 of FIG. 1 is broken.

The first pull-down holding circuit 600, the second pull-down holding circuit 700, and the bridge circuit 800 of FIG. 1 construct the pull-down holding circuit of the three-stage voltage division. If T55 is broken, the first pull-down holding circuit 600 and the second pull-down holding circuit 700 of the new self-healing circuit still can operate as the sub-circuit of the independent two-stages resistance divider, which can ensure the normal function of the pull-down holding circuit.

In the normal situation, since the potential of P(N) and K(N) is obtained by controlling T53 and T63 according to the potential of S(N) and T(N), their potential relationship satisfies that P(N) is smaller than S(N) and K(N) is smaller than T(N). In this kind of situation, the diode TFTs T56 and T66 of self-healing designed are at the turn-off state. But when T55 is broken, if the diode TFTs T56 and T66 of self-healing designed are not included, P(N) and K(N) will be in the floating state. Their potential will be higher during the gate outputting period, which cannot ensure that T43, T42, T33, and T32 can be turned off, and the outputs of Q(N) and G(N) will also be affected. As the self-healing circuit showed in FIG. 1, if T55 is broken, the circuit will become the GOA circuit as showed in FIG. 5. P(N) and K(N) connect to Q(N) and G(N) through the diode, which will end the floating state. Especially during the gate outputting period, when P(N) and K(N) are pulled down to a low potential, the potential relationship will satisfies that P(N) is greater than S(N) and K(N) is greater than T(N). Whereby the diode designed T56 and T66 will be in the turn-on stage, and P(N) and K(N) will be pulled down to the low potential, which ensures that T43, T42, T33, and T32, can be turned off.

Therefore, as described above, T56 and T66 having the function of self-healing are in the turn-off stage in the normal situation, and does not affect the normal operation of the circuits. Only when T55 is in open state or T55 cannot control the potential of P(N) and K(N) due to the increasing of threshold voltage after a long term operation, T56 and T66 will be in the turn-on stage to modulate P(N) and K(N) or compensate the potential control after a long term operation.

With such design, the GOA circuit may operate normally after T55 is shorted and broken. In addition, as the stress applied to the diode TFT with self-healing function is much smaller than that applied to other TFTs, the impact from the bridge TFT T55 of three-stage voltage division to P(N) and K(N), which results from increasing threshold voltage after a long term stress, may be compensated. As long as the gate output is capable of pulling down P(N) and K(N) to the low potential and P(N) and K(N) may remain in relatively high potential during the inactive period while the gate is turned off, the normal outputting function of the GOA circuit would not be affected seriously. As such, the failure risk is decreased, and the yield rate may be increased to some extent.

In summary, the claimed invention provides a circuit design scheme has the ability of self-healing targeting the failure risk of the bridge TFT that play the key role in the manufacture proceed and the practical circuit operation, which is based on a whole new design of the pull-down holding circuit in view of the principle of three-stages voltage division.

Firstly, two diode-designed TFTs are included in the new circuit structure in view of the principle of three-stage voltage division, to perform the self-healing. The main function is that when the bridge TFT operates normally, the basic operation of the original circuit will not be affected. If the bridge TFT is shorted or broke (especially broke), the TFT of self-healing can be in operation. It means that the potential of P(N)/K(N) can be modulated through the potential of S(N)/T(N), and whereby P(N)/K(N) can be pulled down during the operation and operate normally during the inactive period, which will not affect the output of the gate waveform.

Secondly, by including the diode TFT of self-healing, the interaction between S(N)/T(N) and P(N)/K(N) could be performed during the normal operation of GOA, and there is no need to worry about the current leakage of the diode-designed TFT itself. Because the current leakage can achieve the modulation of P(N)/K(N) through S(N)/T(N), and improve the turn-off state of P(N)/K(N) during the operation, which can decreases the delay of gate waveform output.

Thirdly, in view of the stress failure risk due to a long-term GOA circuit operation, the TFTs, which play the key roles of modulating the pull-down of P(N)/K(N) and connect to the point Q in the pull-down holding circuit, have the possibility of the threshold voltage Vth increasing. The diode TFT of self-healing can compensate the effects to the pull-down holding circuit due to the stress action, which can keep the normal operation and will not affect the gate waveform output.

Therefore, the self-healing gate driving circuit of the claimed invention can decrease the failure risk of the pull-down holding circuit due to the manufacturing process or a long term operation of GOA circuit, performing the function of the circuit self-healing, decreasing the effect from the pull-down holding circuit to the delay of gate waveform output, ensuring the well gate waveform output, and increasing the yield rate of the GOA panel and the reliability of a long-term operation of the GOA circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self-healing gate driving circuit, comprising:

a plurality of gate driver on array (GOA) units connected in cascade, and a N-th level horizontal scanning line in a display area is charged according to a control of a N-th level GOA unit; the N-th level GOA unit comprising a pull-up control circuit, a pull-up circuit, a transfer-down circuit, a pull-down circuit, a boast capacitor, a first pull-down holding circuit, a second pull-down holding circuit and a bridge circuit, wherein the pull-up circuit, the pull-down circuit, the first pull-down holding circuit, the second pull-down holding circuit and the boast capacitor respectively connect to a gate signal point and the N-th level horizontal scanning line, the pull-up control circuit and the transfer-down circuit respectively connect to the gate signal point, and the bridge circuit connects between the first pull-down holding circuit and the second pull-down holding circuit and connects to the gate signal point;

the bridge circuit comprising a first thin-film transistor (TFT), wherein a gate of the first TFT connects to the gate signal point, and a drain and a source of the first TFT respectively connect to a first circuit point and a second circuit point;

the first pull-down holding circuit comprising:

a second TFT, wherein a gate of the second TFT is inputted with a second clock signal, and a drain and a source of the second TFT are respectively inputted with a first clock signal and connect to the second circuit point;

a third TFT, wherein a gate of the third TFT connects to a third circuit point, and a drain and a source of the third TFT are respectively inputted with the first clock signal and connect to the second circuit point;

a fourth TFT, wherein a gate of the fourth TFT is inputted with the first clock signal, and a drain and a source of the fourth TFT are respectively inputted with the first clock signal and connect to the third circuit point;

a fifth TFT, wherein a gate of the fifth TFT connects to the second circuit point, and a drain and a source of the fifth TFT are respectively connects to the second circuit point and the third circuit point;

a sixth TFT, wherein a gate of the sixth TFT connects to the gate signal point, and a drain and a source of the sixth TFT are respectively connects to the seeend third circuit point and inputted with a direct-current (DC) low voltage;

a seventh TFT, wherein a gate of the seventh TFT connects to the second circuit point, and a drain and a source of the seventh TFT are respectively inputted with the DC low voltage and connects to the N-th level horizontal scanning line; and an eighth TFT, wherein a gate of the eighth TFT connects to the second circuit point, and a drain and a source of the eighth TFT are respectively inputted with the DC low voltage and connects to the gate signal point;

the second pull-down holding circuit comprising:

a ninth TFT, wherein a gate of the ninth TFT is inputted with the first clock signal, and a drain and a source of the ninth TFT are respectively inputted with the second clock signal and connects to the first circuit point;

a tenth TFT, wherein a gate of the tenth TFT connects to a fourth circuit point, and a drain and a source of the tenth TFT are respectively inputted with the second clock signal and connect to the first circuit point;

a eleventh TFT, wherein a gate of the eleventh TFT is inputted with the second clock signal, and a drain and a source of the eleventh TFT are respectively inputted with the second clock signal and connect to the fourth circuit point;

a twelfth TFT, wherein a gate of the twelfth TFT connects to the first circuit point, and a drain and a source of the twelfth TFT are respectively connect to the first circuit point and the fourth circuit point;

a thirteenth TFT, wherein a gate of the thirteenth TFT connects to the gate signal point, and a drain and a source of the thirteenth TFT are respectively connect to the fourth circuit point and inputted with the DC low voltage;

a fourteenth TFT, wherein a gate of the fourteenth TFT connects to the first circuit point, and a drain and a source of the fourteenth TFT are respectively inputted with the DC low voltage and connect to the N-th level horizontal scanning line; and a fifteenth TFT, wherein a gate of the fifteenth TFT connects to the first circuit point, and a drain and a source of the fifteenth TFT are respectively inputted with the DC low voltage and connect to the gate signal point; and a low potential of the first clock signal and the second clock signal is smaller than the DC low voltage during their operations, and frequencies thereof is smaller than the clock signal inputted to the pull-up circuit, and the first circuit point and the second circuit point are alternatively configured to be at a high potential.

2. The self-healing gate driving circuit as claimed in claim 1, wherein the pull-up control circuit comprising a sixteenth TFT, and a gate of the sixteenth TFT is inputted with a transfer-down signal from the (N−1)-th level GOA unit, and a drain and a source are respectively connect to the (N−1)-th level horizontal scanning line and the gate signal point.

3. The self-healing gate driving circuit as claimed in claim 1, wherein the pull-up circuit comprising a seventeenth TFT, the gate of the seventeenth TFT connects to the gate signal point, and a drain and a source of the seventeenth are respectively inputted with the clock signal and connect to the N-th level horizontal scanning line.

4. The self-healing gate driving circuit as claimed in claim 1, wherein the transfer-down circuit comprising an eighteenth TFT, and a gate of the eighteenth TFT connects to the gate signal point, and a drain and a source of the eighteenth TFT are respectively inputted with the clock signal and outputs a downward signal.

5. The self-healing gate driving circuit as claimed in claim 1, wherein the pull-down circuit comprising a nineteenth TFT, and a gate of the nineteenth TFT connects to a (N+1)-th level horizontal scanning line, and a drain and a source of the nineteenth TFT are respectively connect to the N-th level horizontal scanning line and inputted with the DC low voltage; a twentieth TFT, and a gate of the twentieth TFT connects to the (N+1)-th level horizontal scanning line, and a drain and a source of the twentieth TFT are respectively connect to the gate signal point and inputted with the DC low voltage.

6. The self-healing gate driving circuit as claimed in claim 1, wherein a duty-cycle ratio of the clock signal is 50%.

7. The self-healing gate driving circuit as claimed in claim 1, wherein the first clock signal is inputted to the cascaded GOA units via a common metal line.

8. The self-healing gate driving circuit as claimed in claim 1, wherein the second clock signal is inputted to the cascaded GOA units via a common metal line.

9. The self-healing gate driving circuit as claimed in claim 1, wherein the DC low voltage is inputted to the cascaded GOA units via a common metal line.

10. The self-healing gate driving circuit as claimed in claim 1, an initiating signal is inputted to a pull-up control circuit of the first level GOA unit and to a pull-down circuit of a last level GOA unit.

11. A self-healing gate driving circuit, comprising:

a plurality of gate driver on array (GOA) units connected in cascade, and a N-th level horizontal scanning line in a display area is charged according to a control of a N-th level GOA unit; the N-th level GOA unit comprising a pull-up control circuit, a pull-up circuit, a transfer-down circuit, a pull-down circuit, a boast capacitor, a first pull-down holding circuit, a second pull-down holding circuit and a bridge circuit, wherein the pull-up circuit, the pull-down circuit, the first pull-down holding circuit, the second pull-down holding circuit and the boast capacitor respectively connect to a gate signal point and the N-th level horizontal scanning line, the pull-up control circuit and the transfer-down circuit respectively connect to the gate signal point, and the bridge circuit connects between the first pull-down holding circuit and the second pull-down holding circuit and connects to the gate signal point;

the bridge circuit comprising a first thin-film transistor (TFT), wherein a gate of the first TFT connects to the gate signal point, and a drain and a source of the first TFT respectively connect to a first circuit point and a second circuit point;

the first pull-down holding circuit comprising:

a second TFT, wherein a gate of the second TFT is inputted with a second clock signal, and a drain and a source of the second TFT are respectively inputted with a first clock signal and connect to the second circuit point;

a third TFT, wherein a gate of the third TFT connects to a third circuit point, and a drain and a source of the third TFT are respectively inputted with the first clock signal and connect to the second circuit point;

a fourth TFT, wherein a gate of the fourth TFT is inputted with the first clock signal, and a drain and a source of the fourth TFT are respectively inputted with the first clock signal and connect to the third circuit point;

a fifth TFT, wherein a gate of the fifth TFT connects to the second circuit point, and a drain and a source of the fifth TFT are respectively connects to the second circuit point and the third circuit point;

a sixth TFT, wherein a gate of the sixth TFT connects to the gate signal point, and a drain and a source of the sixth TFT are respectively connects to the seeend third circuit point and inputted with a direct-current (DC) low voltage;

a seventh TFT, wherein a gate of the seventh TFT connects to the second circuit point, and a drain and a source of the seventh TFT are respectively inputted with the DC low voltage and connects to the N-th level horizontal scanning line; and a eighth TFT, wherein a gate of the eighth TFT connects to the second circuit point, and a drain and a source of the eighth TFT are respectively inputted with the DC low voltage and connects to the gate signal point;

the second pull-down holding circuit comprising:

a ninth TFT, wherein a gate of the ninth TFT is inputted with the first clock signal, and a drain and a source of the ninth TFT are respectively inputted with the second clock signal and connects to the first circuit point;

a tenth TFT, wherein a gate of the tenth TFT connects to a fourth circuit point, and a drain and a source of the tenth TFT are respectively inputted with the second clock signal and connect to the first circuit point;

a eleventh TFT, wherein a gate of the eleventh TFT is inputted with the second clock signal, and a drain and a source of the eleventh TFT are respectively inputted with the second clock signal and connect to the fourth circuit point;

a twelfth TFT, wherein a gate of the twelfth TFT connects to the first circuit point, and a drain and a source of the twelfth TFT are respectively connect to the first circuit point and the fourth circuit point;

a thirteenth TFT, wherein a gate of the thirteenth TFT connects to the gate signal point, and a drain and a source of the thirteenth TFT are respectively connect to the fourth circuit point and inputted with the DC low voltage;

a fourteenth TFT, wherein a gate of the fourteenth TFT connects to the first circuit point, and a drain and a source of the fourteenth TFT are respectively inputted with the DC low voltage and connect to the N-th level horizontal scanning line; and a fifteenth TFT, wherein a gate of the fifteenth TFT connects to the first circuit point, and a drain and a source of the fifteenth TFT are respectively inputted with the DC low voltage and connect to the gate signal point; and a low potential of the first clock signal and the second clock signal is smaller than the DC low voltage during their operations, and frequencies thereof is smaller than the clock signal inputted to the pull-up circuit, and the first circuit point and the second circuit point are alternatively configured to be at a high potential;

wherein the pull-up control circuit comprising a sixteenth TFT, and a gate of the sixteenth TFT is inputted with a transfer-down signal from the (N−1)-th level GOA unit, and a drain and a source are respectively connect to the (N−1)-th level horizontal scanning line and the gate signal point;

wherein the pull-up circuit comprising a seventeenth TFT, the gate of the seventeenth TFT connects to the gate signal point, and a drain and a source of the seventeenth are respectively inputted with the clock signal and connect to the N-th level horizontal scanning line;

wherein the transfer-down circuit comprising an eighteenth TFT, and a gate of the eighteenth TFT connects to the gate signal point, and a drain and a source of the eighteenth TFT are respectively inputted with the clock signal and outputs a downward signal;

wherein the pull-down circuit comprising a nineteenth TFT, and a gate of the nineteenth TFT connects to a (N+1)-th level horizontal scanning line, and a drain and a source of the nineteenth TFT are respectively connect to the N-th level horizontal scanning line and inputted with the DC low voltage; a twentieth TFT, and a gate of the twentieth TFT connects to the (N+1)-th level horizontal scanning line, and a drain and a source of the twentieth TFT are respectively connect to the gate signal point and inputted with the DC low voltage; and wherein a duty-ratio of the clock signal is 50%.

12. The self-healing gate driving circuit as claimed in claim 11, wherein the first clock signal is inputted to the cascaded GOA units via a common metal line.

13. The self-healing gate driving circuit as claimed in claim 11, wherein the second clock signal is inputted to the cascaded GOA units via a common metal line.

14. The self-healing gate driving circuit as claimed in claim 11, wherein the DC low voltage is inputted to the cascaded GOA units via a common metal line.

15. The self-healing gate driving circuit as claimed in claim 11, an initiating signal is inputted to a pull-up control circuit of the first level GOA unit and to a pull-down circuit of a last level GOA unit.

* * * * *